United States Patent [19]

White

[11] Patent Number: 4,967,441

[45] Date of Patent: Nov. 6, 1990

[54] TOILET BOWL BRUSH

[76] Inventor: Robert A. White, 11079 Blythville Rd., Springhill, Fla. 33526

[21] Appl. No.: 381,378

[22] Filed: Jul. 18, 1989

[51] Int. Cl.[5] ..... A47L 13/12

[52] U.S. Cl. ..... 15/114; 15/105; 15/209 D; 15/246

[58] Field of Search ..... 15/114, 105, 106, 244.1, 15/111, 117, 118, 164, 246, 209 D, 110

[56] References Cited

U.S. PATENT DOCUMENTS

| | | | |
|---|---|---|---|
| 1,290,565 | 1/1919 | Jarvis | 15/114 |
| 1,544,404 | 6/1925 | Hummel | 15/246 |
| 1,562,285 | 11/1925 | Bibb | 15/118 |
| 1,660,318 | 2/1928 | Anderson | 15/164 |
| 2,576,325 | 11/1951 | Wood | 15/246 X |
| 2,879,532 | 3/1959 | Szabo et al. | 15/114 X |
| 2,946,073 | 7/1960 | Vosbikian et al. | 15/118 |
| 3,399,499 | 9/1968 | Stetz et al. | 15/118 X |
| 3,428,987 | 2/1969 | Loston | 15/114 |
| 3,599,263 | 8/1971 | Cheiten | 15/164 X |

*Primary Examiner*—Philip R. Coe
*Assistant Examiner*—Mark Spisich

[57] ABSTRACT

A standard toilet bowl brush, having a wire loop frame, sometimes lying in a slightly curved plane, supporting encompassing bristles, and with an elongated handle, is converted, temporarily, into a steel wool brush by an adaptor spider which embraces the larger dimension of the brush and projects a forwardly and upwardly canted lance upon which a steel wool or other harsh scrub pad is impaled to enable under-the-rim scrub action where hard deposits build up and discolor from water deposits.

1 Claim, 2 Drawing Sheets

TOILET BOWL BRUSH

BACKGROUND OF THE INVENTION

1. Field of the Invention

Bowl cleaning devices and more specifically a cleaning device especially adapted for reaching up under the rim of a toilet bowl where hard lime deposits tend to accummulate and harbor bacteria.

2. Description of Prior Art

One of the most difficult places to keep free from lime deposits in a toilet bowl is the area under the rim where flush water is directed into the bowl. The ordinary conventional toilet bowl brush is able to reach those areas to some extent, but generally doesn't have sufficient scrubbing power to remove the deposits.

Such deposits have the capability of harboring and propagating bacteria as well as becoming discolored and visually unattractive.

Although it is highly desirable that this under the rim area of the bowl be regularly cleansed to impede the growth of lime deposits and microorganims, it has not been a common practice to do so. The major reason for this is that the location under the rim is resistant to ordinary soft bristle toilet bowl brushes as well as the fact that the ordinary brush does not reach well into that area.

Hence, it can be seen that there is a great need for a harsher cleaning device capable of being manipulated into the rim area of the toilet fixture and performing scrubbing action to physically remove lime deposits and associated debris.

Therefore, it is an object of this invention to augment the scrubbing ability of a toilet bowl brush.

A further object of this invention is to provide a scrub pad as a removable attachment on a conventional toilet bowl brush.

An object of this invention is to provide a special purpose abrasive brush for cleaning hard to reach areas under the rim of a conventional flush commode.

It is a further object of this invention to provide a conversion device for adapting a standard toilet bowl brush to present an abrasive pad to the area under the rim of a water flush toilet.

A still further object of this invention is to enable the conversion device to be renewed by replacement of just the abrasive device.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

Briefly, and in general terms, the present invention resides in a cleaning device for cleaning under the lip bowl of a flush commode.

The cleaning device is a conversion means to employ the handle of a conventional toilet bowl brush, for presenting a scrubbing pad projected beyond the normal perimeter of the brush.

A back brace in the form of a clamp-on "spider" embraces the brush end of the toilet bowl brush and also clamps onto the handle of the brush for stabilizing the spider. The spider then presents a lance projecting beyond the brush head and the scouring pad is impaled upon the lance to do the hard scrubbing action for which this invention is intended.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DEFINITIONS

Toilet bowl brush: Preferably a looped wire core with radially projecting bristles. However, any brush configuration or pad having a handle for scrubbing a bowl. Experience has proven the well-known loop of wire with radiating bristles to be practical, efficient and economical.

Scouring pad: Preferably a snub-nose steel wool pad, having a flat base and a cavity opening along a transverse plane from said base. However, any clump of scouring material may be impaled upon the lance of the back brace.

Brace or back brace: Preferably and economically, a planer sheet to lie superposed over the loop face of a toilet bowl brush to hold a forwardly projecting lance, over which a scrubbing pad may be impaled.

Claws: Members which depend from the general plane of the back brace and embrace the brush portion of a toilet bowl brush to removably secure the back brace to the brush portion.

Brush handle clamp: Preferably a snap-on portion of the back brace, having a C-clamp cross-section configuration, adapted thereby to stabilize the back brace to the brush.

DETAILED DISCUSSION

There are many and varied prior art devices for cleaning toilet bowls, including brushes specifically designed to clean under the lip of the toilet bowl. However, special purpose brushes are seldom kept or used in the ordinary household, even though perhaps acceptable to commercial or professional cleaners.

On the other hand, this invention provides a simple, easy to store, adaptor for the universally recognized and accepted configuration of a toilet bowl brush. Such brushes are usually provided with an attractive stand for holding the brush when not in use, and are found in most households. This invention enables the facile adapting of such brushes for the specific under the rim cleaning operation often done by hand because of the tenacious nature of hard water deposits in that area of the toilet bowl, and the lack of a specific tool to augment the soft brushing action of a bristle brush.

Figure 1:
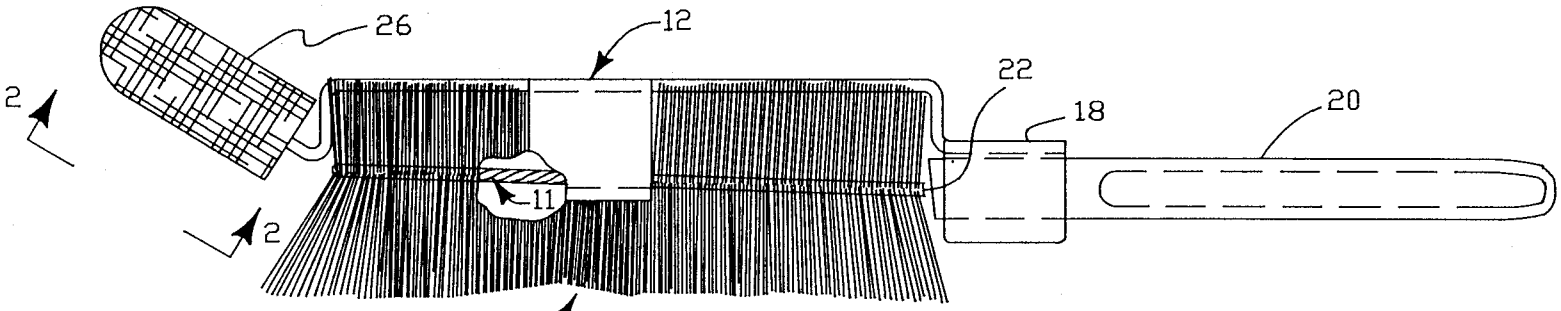
FIG. 1 is a side elevation of a toilet bowl brush of well-known design, with the scrub attachment of this invention in place, and a portion broken away to reveal the wire frame of the brush.
Figure 2:
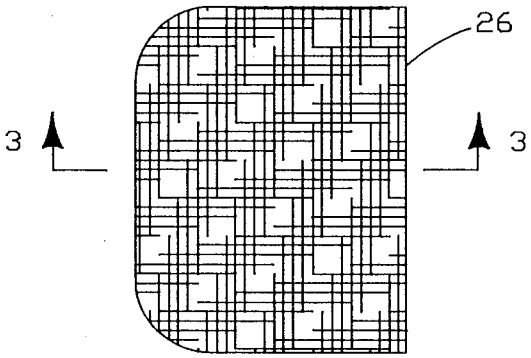
FIG. 2 is a plan view of a scrub pad taken along line 2—2 of FIG. 1.
Figure 3:
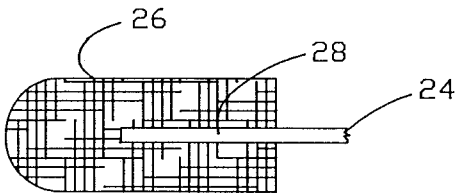
FIG. 3 is a sectional view taken along line 3—3 of FIG. 2.

The drawings illustrate a toilet bowl brush 10 of widely known and accepted configuration. In FIG. 1 the brush is broken away to reveal the wire frame 11, which is a looped wire core with radially projecting bristles, the bristles in most brushes of this nature, are gripped and entrapped in the plurality of individual wires making up the wire frame 11. However, any brush configuration or pad having a handle for scrubbing a bowl will serve as a base for this invention. The purpose of using the conventional brush is simply to provide a handle to enable the facile handling of a scrubbing pad for reaching up under the bowl lip of a toilet. Experience has proven that the well-known loop of wire with radiating bristles to be practical, efficient and economical.

Figure 5:
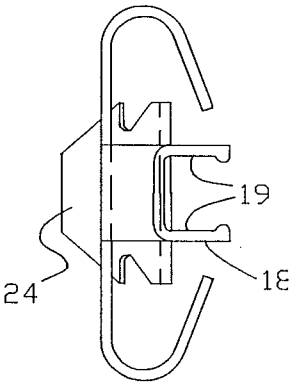
FIG. 5 is an end view taken along line 5—5 of FIG. 4.
Figure 7:
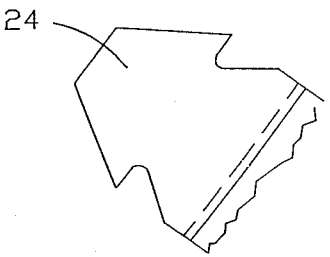
FIG. 7 is a view of the lance portion of the adaptor as viewed along line 7—7 of FIG. 6.
Figure 4:
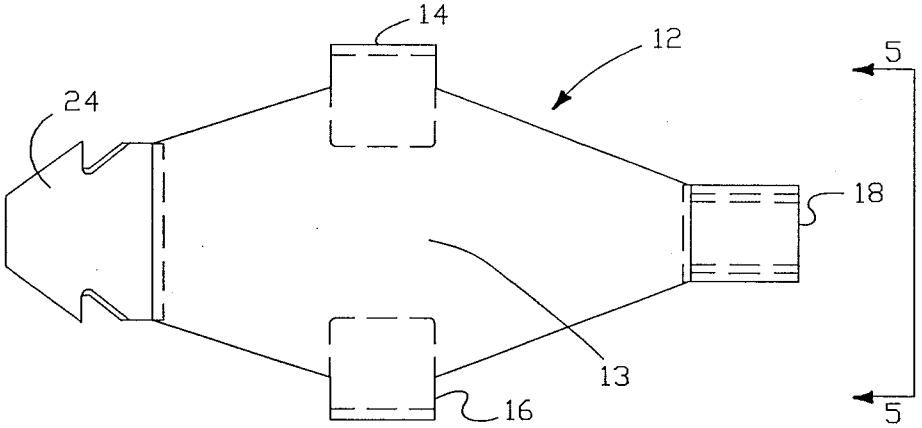
FIG. 4 is a plan view of the adaptor back brace of this invention.
Figure 6:
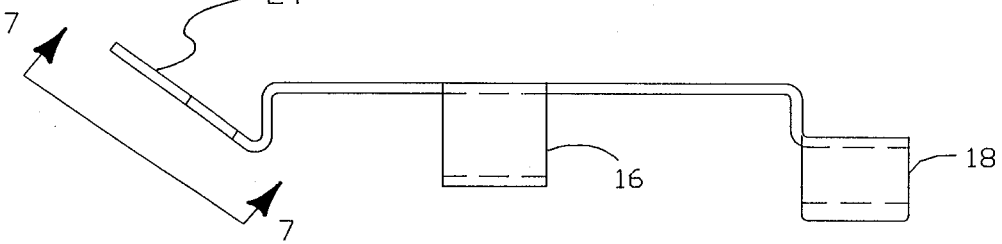
FIG. 6 is a side elevational view of the FIG. 1 adaptor.

To adapt the brush 10 for the purpose of this invention, a back brace 12, composed of a plate 13 and claws 14 and 16, is dimensioned to lie superposed over the loop face of the toilet bowl brush 10. The plate 13 is held by the depending claws 14 and 16 which may be resilient members which can spring outwardly and then clamp down on the brush, or may be made of ductile metal which may easily be deformed to clamp upon the brush. In either case, the back brace, held in place by the claws 14 and 16 is stabilized by means of a handle clamp 18 which may be seen best in FIG. 5. Here it is seen that the clamp 18 is composed of sidewalls 19 which are dimensioned to fit with a snap action clamping force upon a brush handle 20. Refer to FIG. 1 where it is seen that the handle clamp 18 and the claws 14 and 16 provide a three point gripping action which holds the plate 13 steadily and firmly upon the face of the brush as shown in FIG. 1. The handle 20 terminates at the juncture of the wire frame 11 and is referred to as a base of the brush.

The structure as thus described is employed for the purpose of presenting a forwardly positioned lance 24 portion of the brace projecting beyond the parameter of the brush for impaling and holding a scouring pad 26.

Experience has shown that presenting the lance 24 at a fifty degree angle with respect to the plane of the plate 13 provides the most useful attitude for reaching under the rim of the toilet bowl.

Although any scouring pad may be impaled upon the lance 24 for providing the scrubbing action, preferably, a steel wool pad 26, having a preformed cavity 28 will enable a pad to be forced down over the lance 24 and be removable to replace with a fresh pad when the cleansing action of the pad is no longer acceptable.

For example, the pad 26 may be impregnated with detergents, sanitation chemicals and deodorants. When these materials are exhausted, it is expeditious to discard the pad 26 and provide a fresh new pad.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. In combination:

a toilet bowl brush having a loop spine with a plurality of scrub bristles radiating around the spine, and a handle, said loop spine attached to said handle, said loop spine and handle lying substantially in a common plane;

a brace back plate juxtapositioned over said loop spine, and removably secured to said brush by gripping claws depending from said back plate and partially looping around said spine and bristles, said claws spacing said back plate a distance less than the length of said bristle pile, whereby said brace is held firmly to said brush by the resiliency of said bristles; and a lance portion of the brace projecting in a direction opposite said handle and at an angle to the plane of said spine, said lance having side hook formations for resisting removal of a scrub pad impailed thereon.

* * * * *